US009768534B2

(12) United States Patent
Kurachi et al.

(10) Patent No.: US 9,768,534 B2
(45) Date of Patent: Sep. 19, 2017

(54) ELECTRIC CONNECTORS AND ELECTRIC CONNECTOR DEVICE

(71) Applicant: DAI-ICHI SEIKO CO., LTD., Kyoto-shi (JP)

(72) Inventors: Takaki Kurachi, Fukuoka (JP); Tetsuya Tagawa, Tokyo (JP)

(73) Assignee: DAI-ICHI SEIKO CO., LTD., Kyoto-shi (JP)

( * ) Notice: Subject to any disclaimer, the term of this patent is extended or adjusted under 35 U.S.C. 154(b) by 0 days.

(21) Appl. No.: 14/937,013

(22) Filed: Nov. 10, 2015

(65) Prior Publication Data

US 2016/0156116 A1 Jun. 2, 2016

(30) Foreign Application Priority Data

Nov. 28, 2014 (JP) ..... 2014-241551

(51) Int. Cl.
*H01R 9/03* (2006.01)
*H01R 12/70* (2011.01)
(Continued)

(52) U.S. Cl.
CPC ..... *H01R 12/7005* (2013.01); *H01R 12/62* (2013.01); *H01R 12/775* (2013.01);
(Continued)

(58) Field of Classification Search
CPC H01R 23/7073; H01R 23/688; H01R 23/725; H01R 13/62933; H01R 23/6873; H01R 13/658; H01R 12/79; H01R 23/662
(Continued)

(56) References Cited

U.S. PATENT DOCUMENTS 6,500,013 B1 * 12/2002 Wang ..... H01R 12/598 439/108
7,094,092 B2 * 8/2006 Yang ..... H01R 13/6593 439/495
(Continued)

FOREIGN PATENT DOCUMENTS

JP 4-6183 U 1/1992
JP 2001-332360 A 11/2001
(Continued)

OTHER PUBLICATIONS

Japanese Office Action issued Aug. 17, 2016 in Patent Application No. 2014-241551 (without English Translation).
(Continued)

*Primary Examiner* — Thanh Tam Le
(74) *Attorney, Agent, or Firm* — Oblon, McClelland, Maier & Neustadt, L.L.P.

(57) ABSTRACT

Electromagnetic shielding about a part connected with a wiring substrate is easily and reliably carried out by a simple configuration without impairing productivity. A fixed shield plate provided at a shield shell member of an electric connector mounted on a wiring substrate is disposed to be opposed to a vicinity of a substrate connecting leg portion of a contact member. A movable shield plate covering a shell opening by a moving operation is provided. At least the substrate connecting leg portion of the contact member is covered from an outer side by fixed and movable shield plates, thereby well carrying out electromagnetic shielding (shielding) with respect to the part connected with the wiring substrate. Until the movable shield plate is subjected to the moving operation, the part connected with the wiring substrate can be checked well through the shell opening.

16 Claims, 15 Drawing Sheets

(51) Int. Cl.
*H01R 13/639* (2006.01)
*H01R 13/6581* (2011.01)
*H01R 12/62* (2011.01)
*H01R 12/77* (2011.01)
*H01R 13/6593* (2011.01)

(52) U.S. Cl.
CPC ..... *H01R 13/639* (2013.01); *H01R 13/6581* (2013.01); *H01R 13/6593* (2013.01)

(58) Field of Classification Search
USPC ..... 439/74, 79, 108, 372, 607.31, 607.35, 439/607.4, 607.41, 607.49, 495, 497
See application file for complete search history.

(56) References Cited

U.S. PATENT DOCUMENTS 7,585,185 B2 * 9/2009 Obikane ..... H01R 13/65802 439/108
7,722,387 B2 * 5/2010 Yamaji ..... H01R 23/6873 439/497
8,241,065 B2 * 8/2012 Ikari ..... H01R 12/775 439/372
8,317,543 B2 * 11/2012 Tagawa ..... H01R 12/598 439/374
8,465,324 B2 * 6/2013 Ikari ..... H01R 12/79 439/495
8,550,849 B2 * 10/2013 Yamaji ..... H01R 12/725 439/495
8,602,812 B2 * 12/2013 Ohsaka ..... H01R 12/775 439/497
8,727,803 B2 * 5/2014 Kurachi ..... H01R 13/639 439/497
9,397,447 B2 * 7/2016 Kurachi ..... H01R 12/79

FOREIGN PATENT DOCUMENTS

JP 2007-073426 3/2007
JP 2009-515317 4/2009
JP 2011-238410 11/2011

OTHER PUBLICATIONS

Office Action issued Apr. 20, 2017 in Korean Patent Application No. 10-2015-0141516.

* cited by examiner

ELECTRIC CONNECTORS AND ELECTRIC CONNECTOR DEVICE

BACKGROUND OF THE INVENTION

Field of the Invention

The present invention relates to electric connectors and an electric connector device provided with contact members connected to electrically-conductive paths on a wiring substrate.

Description of Related Art

Generally, in various electric devices, etc., electric connector devices are widely used to connect the terminal parts of various signal transmission media consisting of a FPC (flexible printed circuit), a FFC (flexible flat cable), or coaxial cables to a printed wiring substrate. The electric connector device is configured so that a plug connector coupled to signal transmission media such as coaxial cables is inserted into a receptacle connector mounted on a printed wiring substrate, thereby mating both of the electric connector with each other; and signal transmission is configured to be carried out through electrically-conductive contact members (electrically-conductive terminals), which are arranged on connector main body portions (insulating housings) of both of the electric connectors so as to form multipolar shapes.

In such an electric connector device, conventionally, in order to reduce the influence of electromagnetic-wave noise from outside with respect to transmission signals and to reduce the electromagnetic-wave noise radiated toward outside, a configuration in which the outer surfaces of the connector main body portions (insulating housings) and the outer side of the contact members are covered with electrically-conductive shield shell members or shield plates consisting of thin metal plate members is often employed.

However, particularly in recent years, as the frequencies of transmission signals are further increased, not only for the main parts of the contact members (electrically-conductive terminals), but also for the parts connected with the wiring substrate, it is becoming necessary to remove the influence of the electromagnetic-wave noise from outside and to reliably prevent external radiation of the electromagnetic-wave noise from the parts connected with the contact members.

Conventional electric connector devices include a case in which an electrically-conductive tape is pasted onto the connected parts of the contact members and the wiring substrate and a case in which an electrically-conductive shell is extended to cover the connected parts. However, the case in which the electrically-conductive tape has a tendency that productivity is reduced since a comparatively labor-taking operation process of pasting the electrically-conductive tape is added. For example, in the case in which the parts connected with the wiring substrate are covered by extending the electrically-conductive shell of the receptacle connector, there is a risk that the connected parts of the contact members and the wiring substrate may not be checked by a visual check, imaging test, etc., and there is a problem that it becomes difficult to test/check whether a connecting operation of the contact members, etc. is carried out with no problem or not.

We disclose Japanese Unexamined Patent Application Publications No. 2007-73426 and 2011-238410 as examples of related art.

SUMMARY OF THE INVENTION

Therefore, it is an object of the present invention to provide electric connectors and an electric connector device that enable, by a simple configuration, easy and reliable electromagnetic shielding about the parts connected with the wiring substrate.

The invention according to a first aspect for achieving the above described object employs a configuration of an electric connector having a connector main body portion mated with a counterpart connector in a state in which the electric connector is mounted on a wiring substrate, a shield shell member covering at least part of the connector main body portion and attached to the connector main body portion, and a contact member attached to the connector main body portion and having a substrate connecting leg portion connected to an electrically-conductive path on the wiring substrate; wherein a ground-connecting electrically-conductive path is formed on a surface part of the wiring substrate and at a vicinity position of a part to which the substrate connecting leg portion of the contact member is connected; the shield shell member is provided with a fixed shield plate rising from a surface of the wiring substrate and disposed to be opposed to a vicinity of the substrate connecting leg portion of the contact member in a state in which the fixed shield plate is solder-connected to the ground-connecting electrically-conductive path, and a shell opening exposing the substrate connecting leg portion of the contact member toward a direction perpendicular to the surface of the wiring substrate; a movable shield plate covering the shell opening is provided to be reciprocable between an unshielded position at which the shell opening is in an open state and a shielded position at which the shell opening is in a closed state; and the movable shield plate is configured so as to contact the fixed shield plate when the movable shield plate is moved to the shielded position.

The invention according to a second aspect employs a configuration in which an electric connector device having a first connector to which a terminal part of a signal transmission medium is coupled and a second connector mated with the first connector in a state in which the second connector is mounted on a surface of a wiring substrate, a connector main body portion of the second connector to which a second shield shell member covering at least part of the connector main body portion is attached, a second contact member attached to the second connector having a substrate connecting leg portion connected to an electrically-conducive path on the wiring substrate; wherein a ground-connecting electrically-conductive path is formed on a surface part of the wiring substrate and at a vicinity position of a part to which the substrate connecting leg portion of the second contact member is connected; the second shield shell member is provided with a fixed shield plate rising from a surface of the wiring substrate and disposed to be opposed to a vicinity of the substrate connecting leg portion of the contact member in a state in which the fixed shield plate is solder-connected to the ground-connecting electrically-conductive path, and a shell opening exposing the substrate connecting leg portion of the contact member toward a direction perpendicular to the surface of the wiring substrate; the first connector or the second connector is provided with a movable shield plate covering the shell opening, the movable shield plate provided to be reciprocable between an unshielded position at which the shell opening is in an open state and a shielded position at which the shell opening is in a closed state; and the movable shield plate is configured so as to contact the fixed shield plate when the movable shield plate is moved to the shielded position.

According to the invention according to claim 1 or claim 2 provided with such a configuration, first, the substrate connecting leg portion of the contact member or the second contact member is covered from the outer side in the direction parallel to the surface of the wiring substrate (extending direction of the wiring substrate) by the fixed shield plate, and the movable shield plate is subjected to the turning operation so as to cover the shell opening after both of the electric connectors are mutually mated. As a result, the substrate connecting portion of the contact member or the second contact member is covered by the movable shield plate from the perpendicularly upper side of the wiring substrate. Therefore, electromagnetic shielding (shielding) with respect to the part connected with the wiring substrate is carried out well. Since the fixed shield plate is connected to the ground-connecting electrically-conductive path disposed in the vicinity of the substrate connecting portion of the contact member or the second contact member, ground connection is carried out at the vicinity position of the part at which electromagnetic shielding is carried out, and a good electromagnetic shielding characteristic is obtained. Moreover, since the part connected with the wiring substrate is exposed to the outer side through the shell opening until the movable shield plate is subjected to the turning operation to the position at which the shell opening is covered, the connection state at the connected part is checked well.

Herein, according to the invention according to a third aspect, the movable shield plate can be turnably provided at the counterpart connector or the first connector. Moreover, according to the invention according to a fourth aspect, the movable shield plate can be turnably provided at the shield shell member or the second connector.

Furthermore, according to the invention according to a fifth aspect, it is desired that a mating retaining member be turnably attached to the counterpart connector or the first connector; in a case in which both of the connectors are mutually mated, the mating retaining member be configured to be turned from an unmated position to a mating working position so as to maintain a mutually mated state of both of the connectors; and the mating retaining member be integrally provided with the movable shield plate.

According to the invention according to a fifth aspect provided with such a configuration, when the mating retaining member is subjected to the turning operation after both of the connectors are mutually mated, the mutual mating state of both of the connectors is maintained well, and, at the same time, electromagnetic shielding with respect to the contact member is carried out. Moreover, the ground connection for carrying out the electromagnetic shielding (shielding) is reliably and firmly carried out by the gripping force of the mating retaining member, and the electromagnetic shielding characteristic is further improved.

Furthermore, according to the invention according to a sixth aspect, it is desired that the movable shield plate be provided with a plurality of plate-spring-shaped members that elastically contact the fixed shield plate.

According to the invention according to the sixth aspect provided with such a configuration, since the movable shield plate and the fixed shield plate contact each other well via the plate-spring-shaped members, the electromagnetic shielding (shielding) characteristic is further improved.

Furthermore, according to the invention according to a seventh aspect, it is desired that a lock portion that retains the mating retaining member at the mating working position be provided.

According to the invention according to the seventh aspect provided with such a configuration, the mutual mating state of both of the connectors is maintained well by the lock portion.

As described above, in addition to a configuration in which the fixed shield plate provided in the shield shell member of the electric connector mounted on the wiring substrate is disposed so as to be opposed to the vicinity of the substrate connecting leg portion of the contact member in the direction parallel to the surface of the wiring substrate (extending direction of the wiring substrate) the present invention employs a configuration in which, the movable shield plate that covers the shell opening by the moving operation after both of the connectors are mutually mated is provided, at least the substrate connecting leg portion of the contact member is covered from the outer side by the fixed shield plate and the movable shield plate, electromagnetic shielding (shielding) with respect to the part connected with the wiring substrate is carried out well, the fixed shield plate is connected to the ground-connecting electrically-conductive path disposed in the vicinity of the substrate connecting leg portion of the contact member, ground connection is established at the vicinity position of the part at which electromagnetic shielding is carried out, and, while a good electromagnetic shielding characteristic is obtained, until the movable shield plate is subjected to the moving operation so as to cover the shell opening, the part connected with the wiring substrate is exposed to the outer side through the shell opening, and the connection state at the connected part can be checked well. Therefore, electromagnetic shielding about the part connected with the wiring substrate can be carried out well reliably by a simple configuration without impairing productivity, and the reliability of the electric connector and the electric connector device can be significantly increased at low cost.

DETAILED DESCRIPTION OF THE PREFERRED EMBODIMENTS

Hereinafter, an embodiment of a case in which the present invention is applied to an electric connector and an electric connector device which connect a plurality of coaxial cables to a printed wiring substrate side will be explained in detail based on drawings.

[Outline of Overall Structure of Electric Connector Device]

Figure 1:
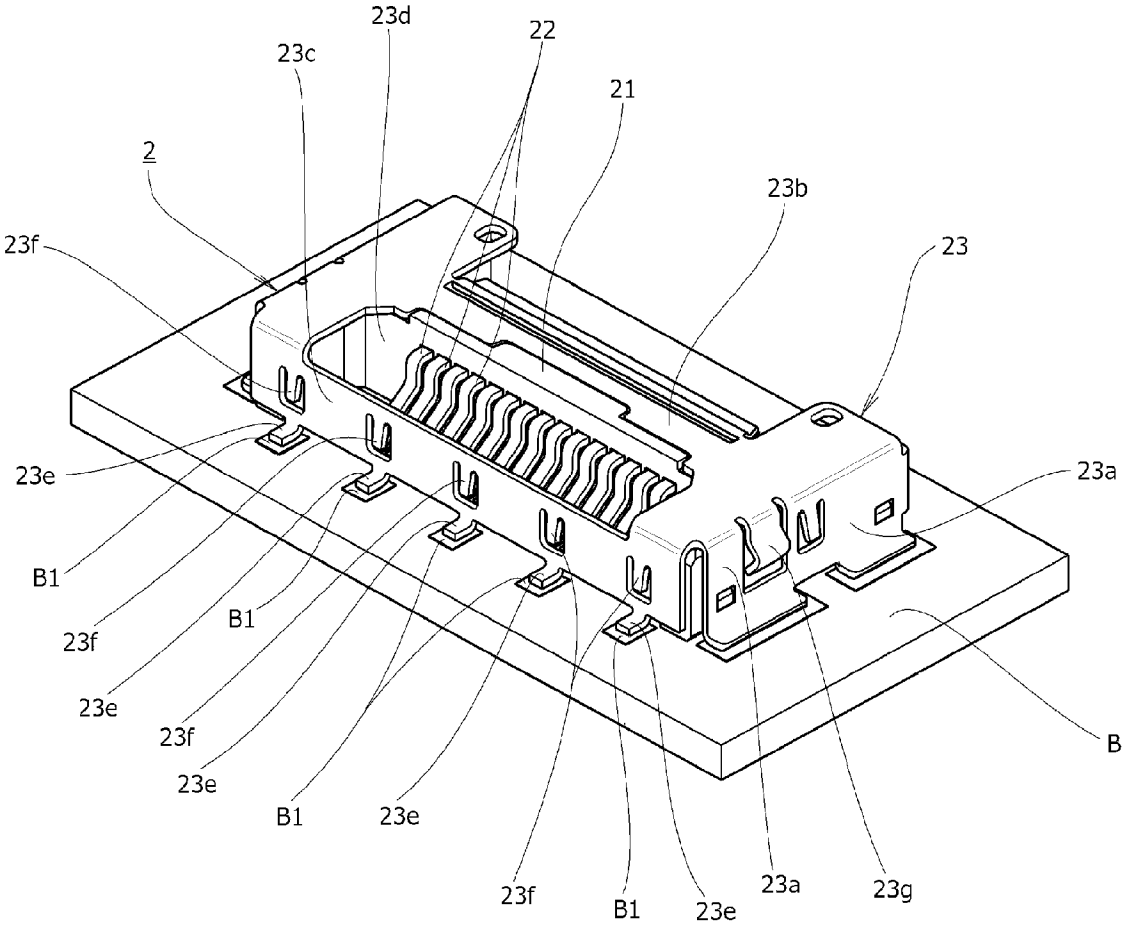
FIG. 1 is an appearance explanatory perspective view showing a receptacle connector (second connector) according to a first embodiment of the present invention from an upper side in a connector rear side.
Figure 2:
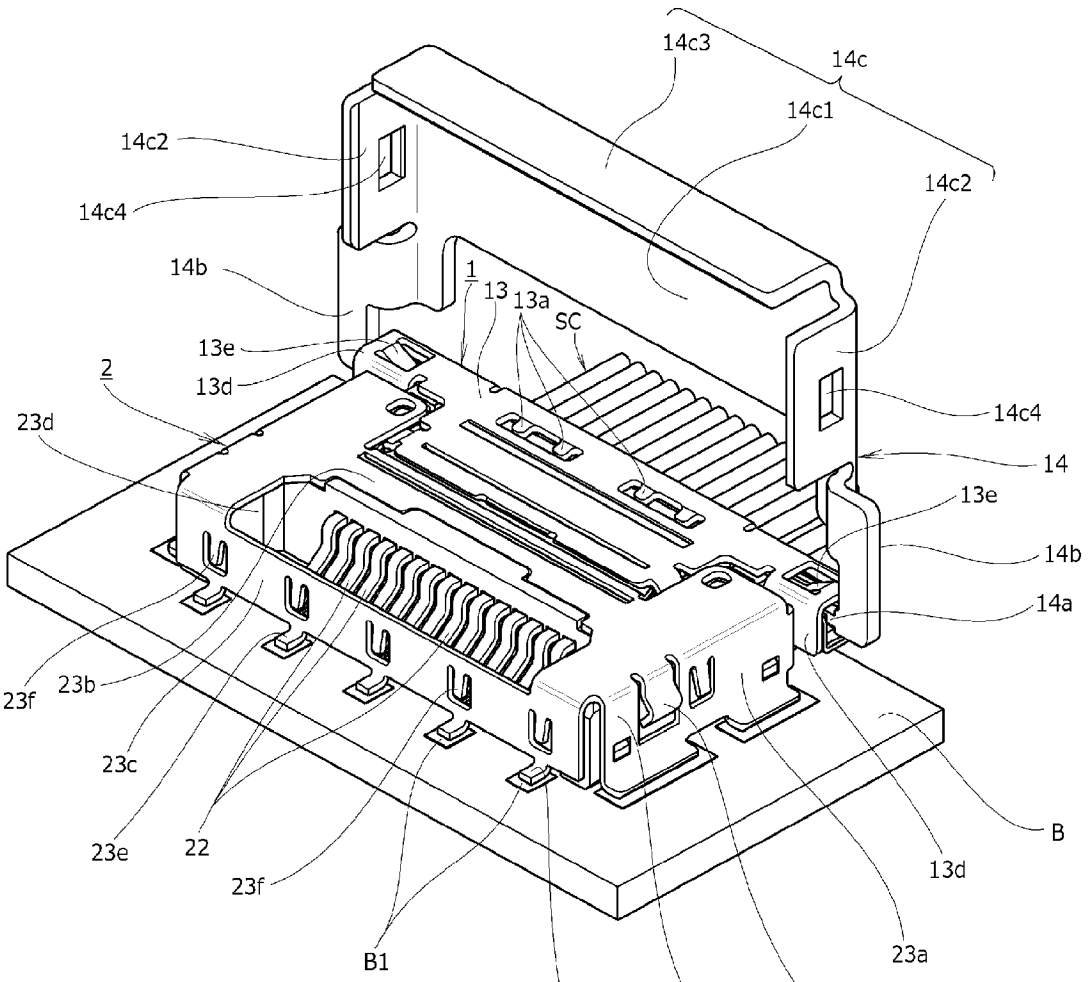
FIG. 2 is an appearance explanatory perspective view showing an electric connector device in a state immediately after a plug connector (first connector) serving as a counterpart connector is mated with the receptacle connector (second connector) according to the first embodiment of the present invention shown in FIG. 1.
Figure 3:
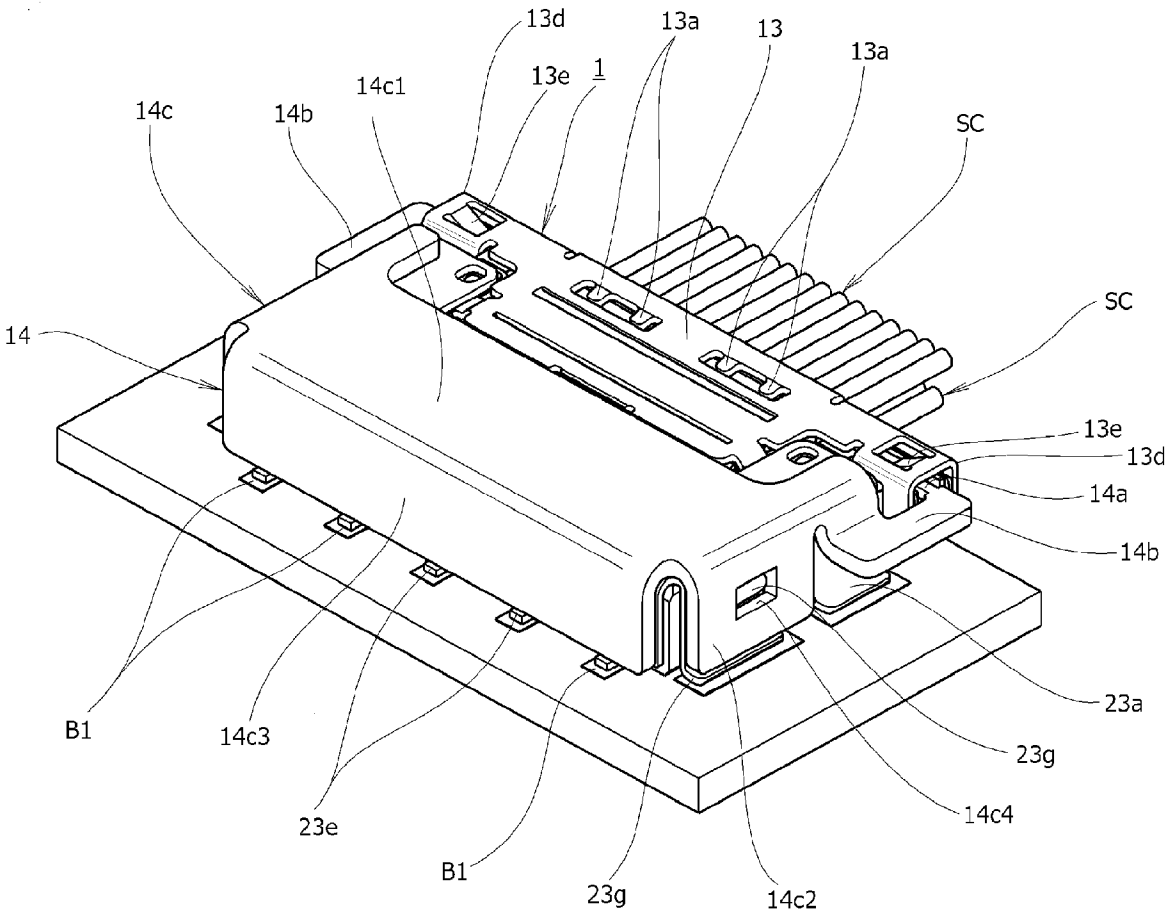
FIG. 3 is an appearance explanatory perspective view showing the electric connector device in a state after a mating retaining member at an "unmated position" in the state of FIG. 2 has undergone a turning operation to a "mating working position"
Figure 4:
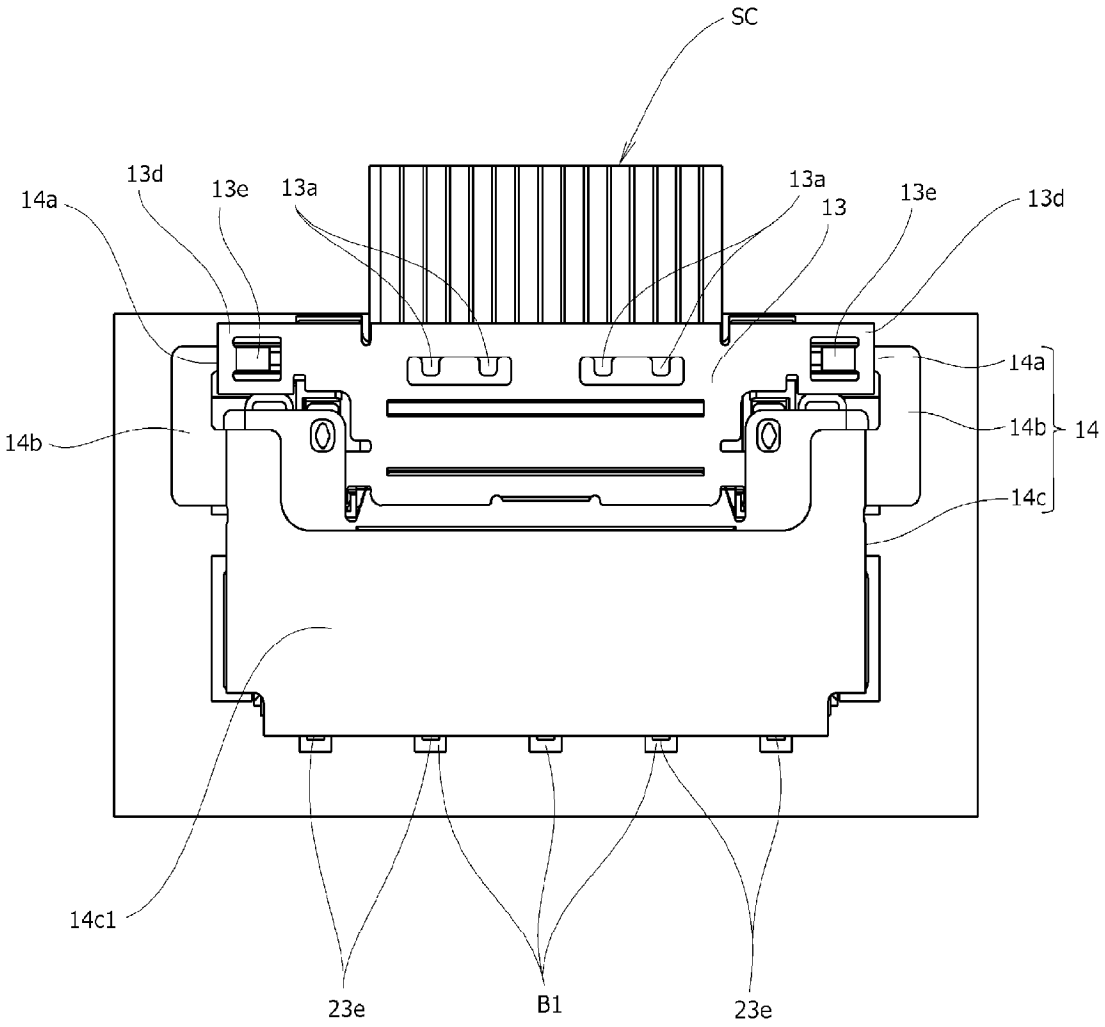
FIG. 4 is an explanatory plan view showing the electric connector device in the state in which both of the connectors shown in FIG. 3 are mated with each other.
Figure 5:
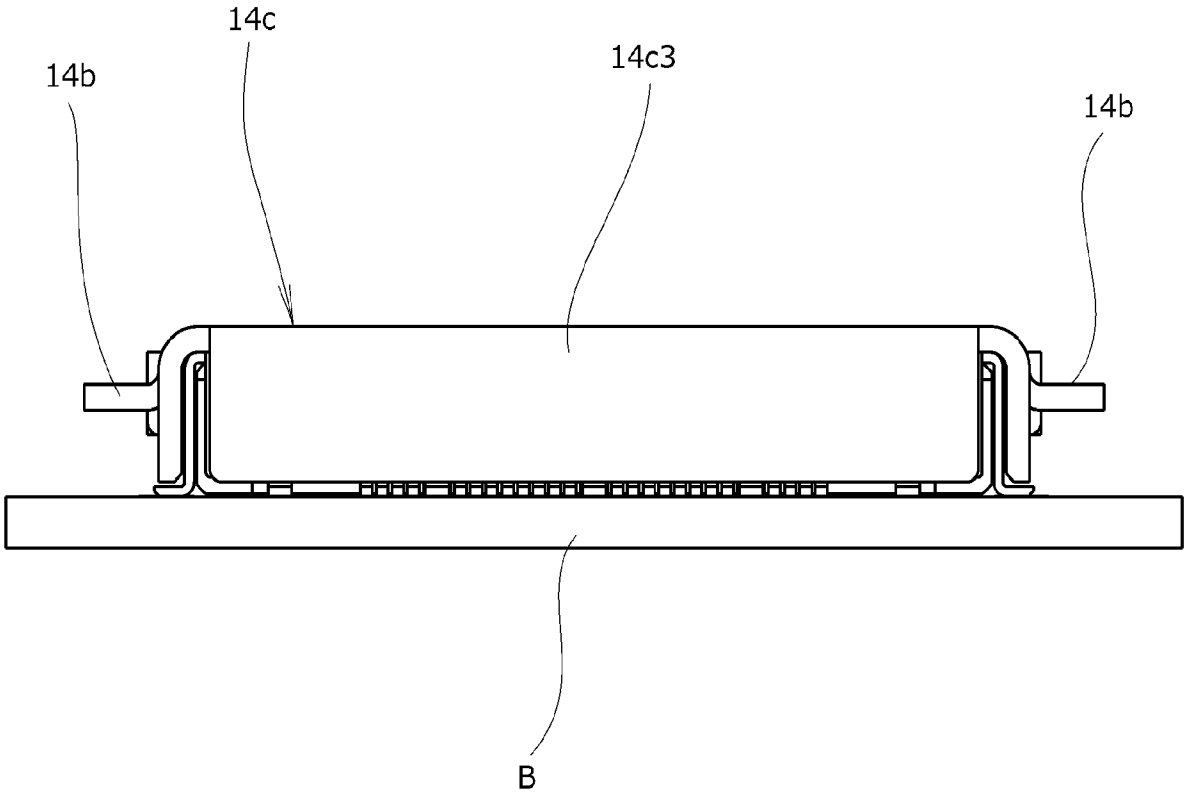
FIG. 5 is an explanatory front view showing the electric connector device in the state in which both of the connectors shown in FIG. 3 and FIG. 4 are mated with each other.
Figure 6:
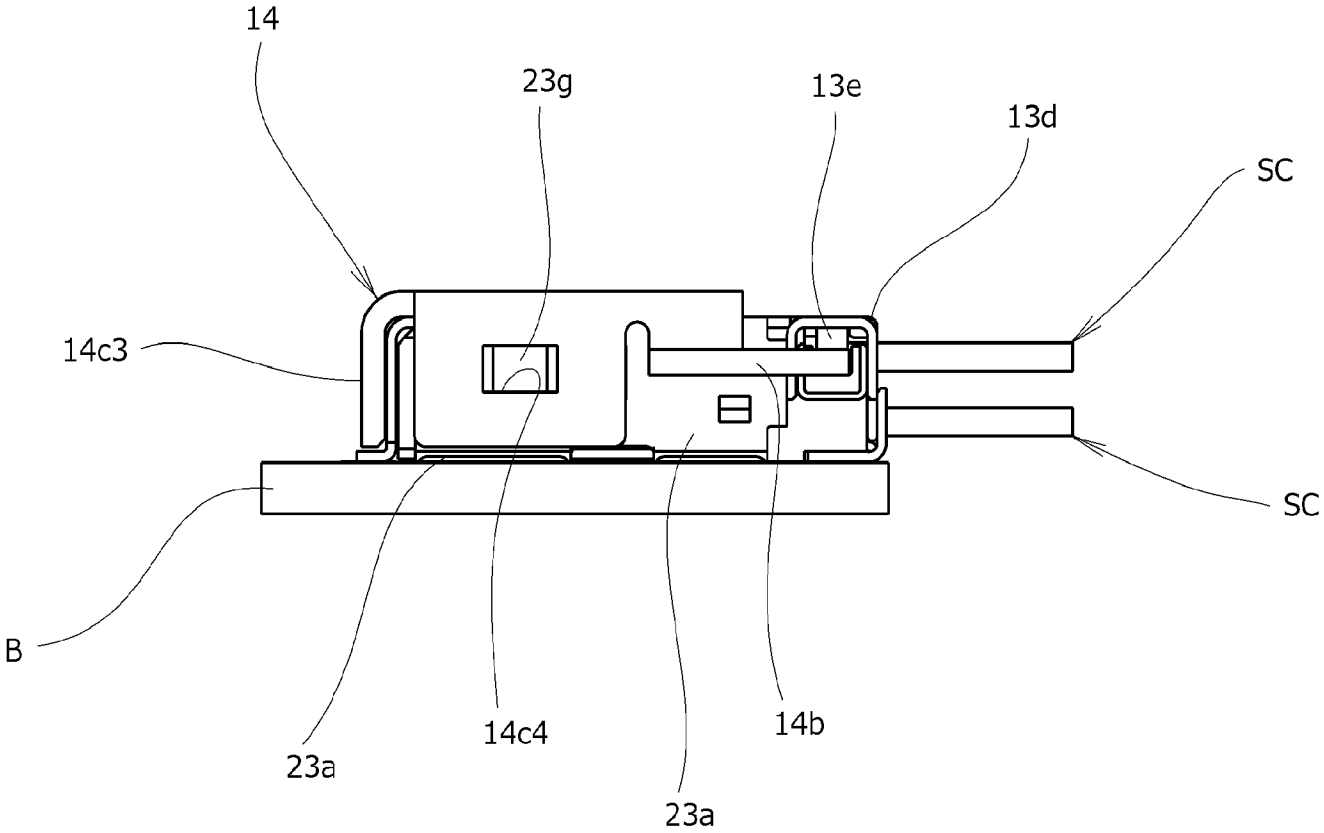
FIG. 6 is an explanatory side view showing the electric connector device in the state in which both of the connectors shown in FIG. 3 and FIG. 4 are mated with each other.
Figure 7:
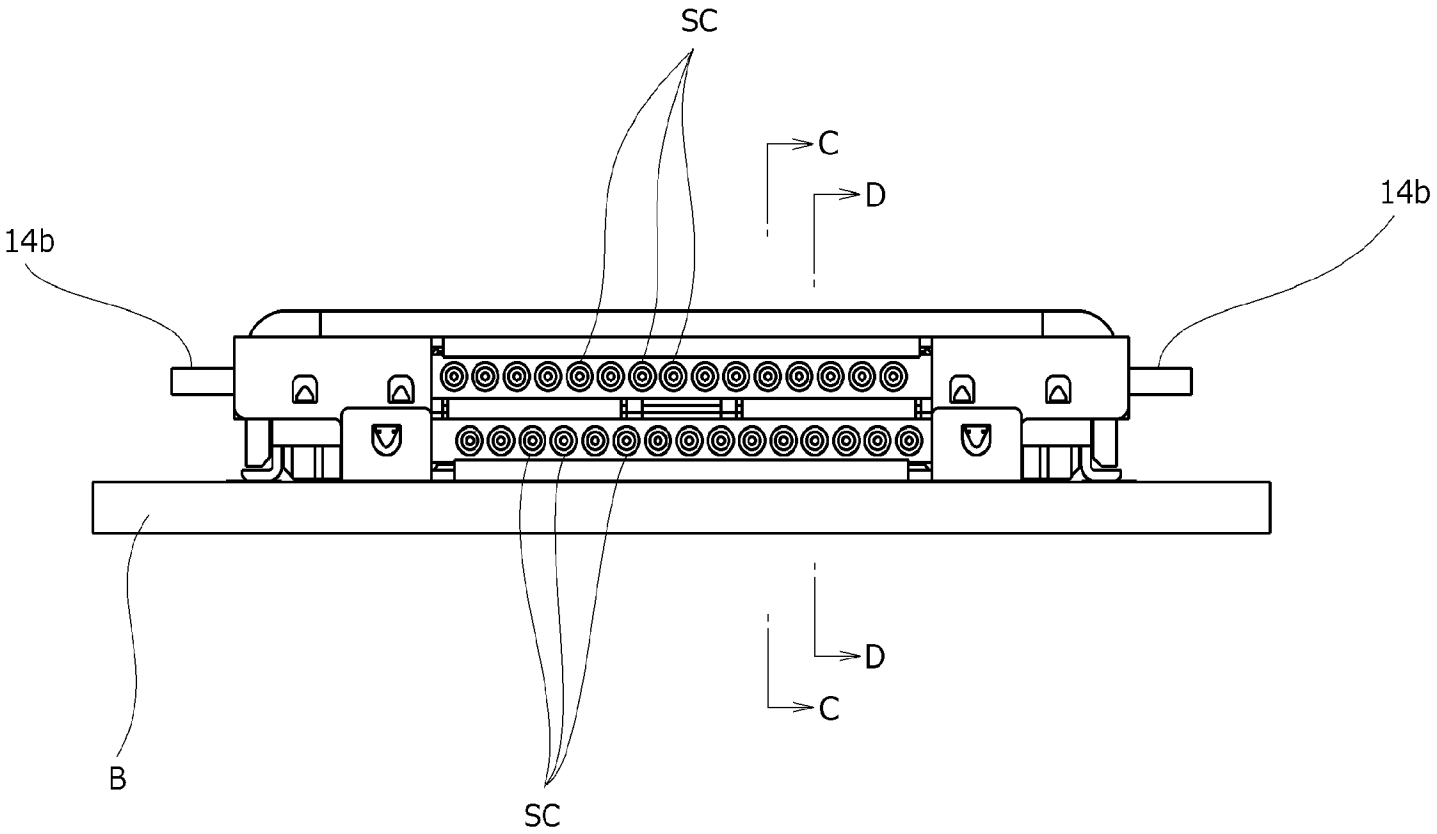
FIG. 7 is an explanatory back side view showing the electric connector device in the state in which both of the connectors shown in FIG. 3 and FIG. 4 are mated with each other.
Figure 8:
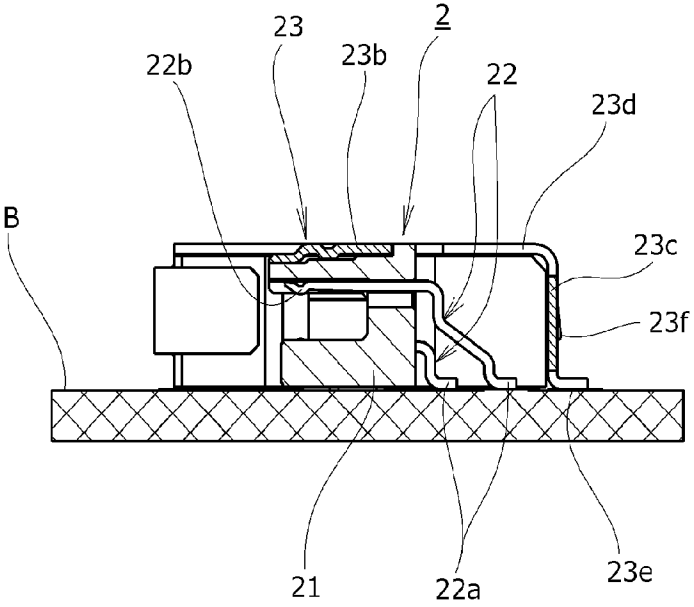
FIG. 8 is an explanatory transverse cross-sectional view, in a direction orthogonal to a connector longitudinal direction, taken at a cross-sectional position of a lower-level-side coaxial cable of the electric connector device in a state before both of the connectors shown in FIG. 2 to FIG. 7 are mated with each other.
Figure 8:
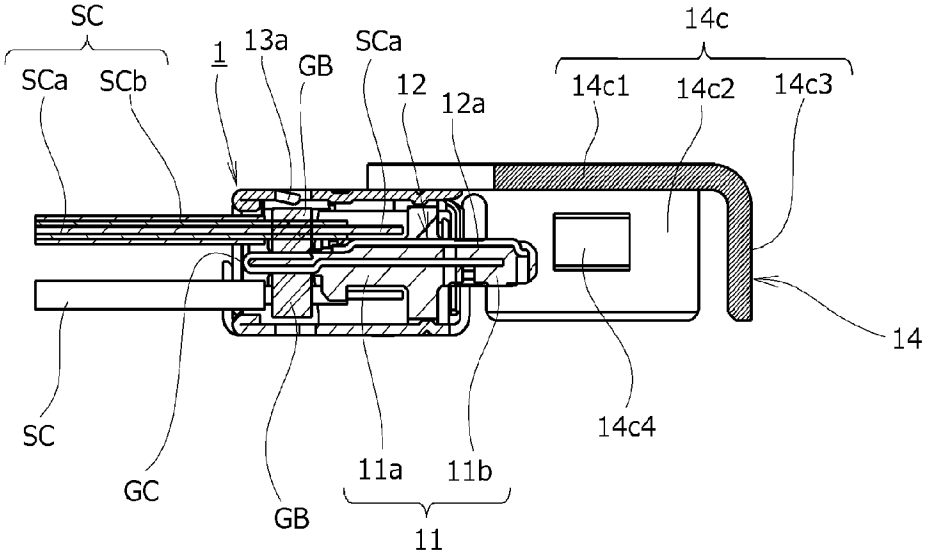
Figure 9:
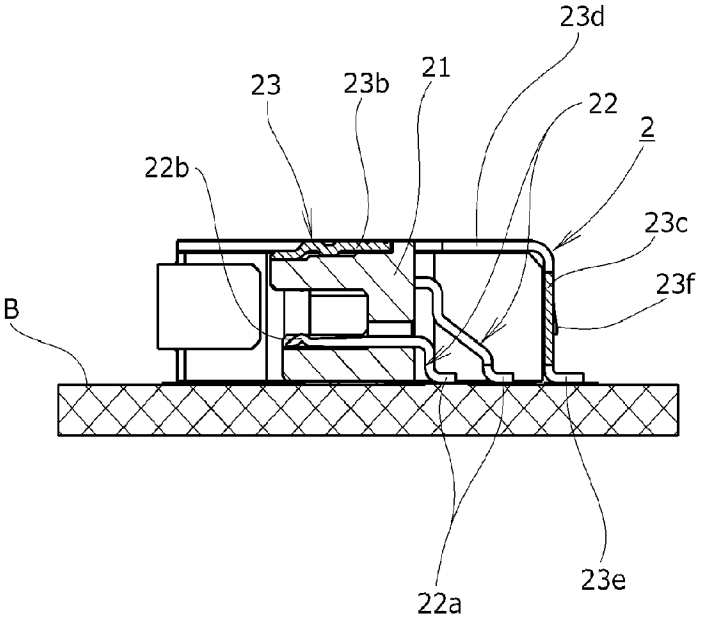
FIG. 9 is an explanatory transverse cross-sectional view, in a direction orthogonal to the connector longitudinal direction, taken at a cross-sectional position of an upper-level-side coaxial cable of the electric connector device in a state before both of the connectors shown in FIG. 2 to FIG. 7 are mated with each other.
Figure 9:
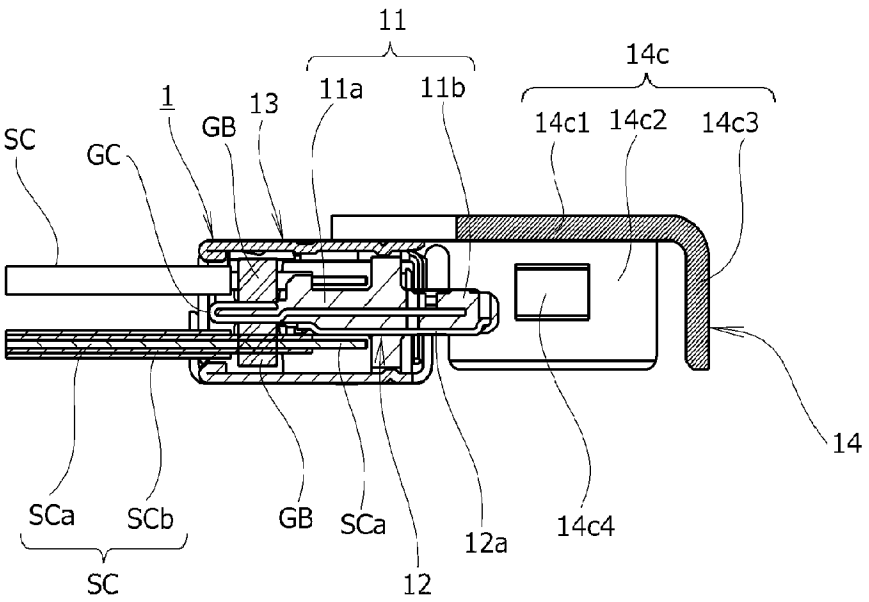
Figure 10:
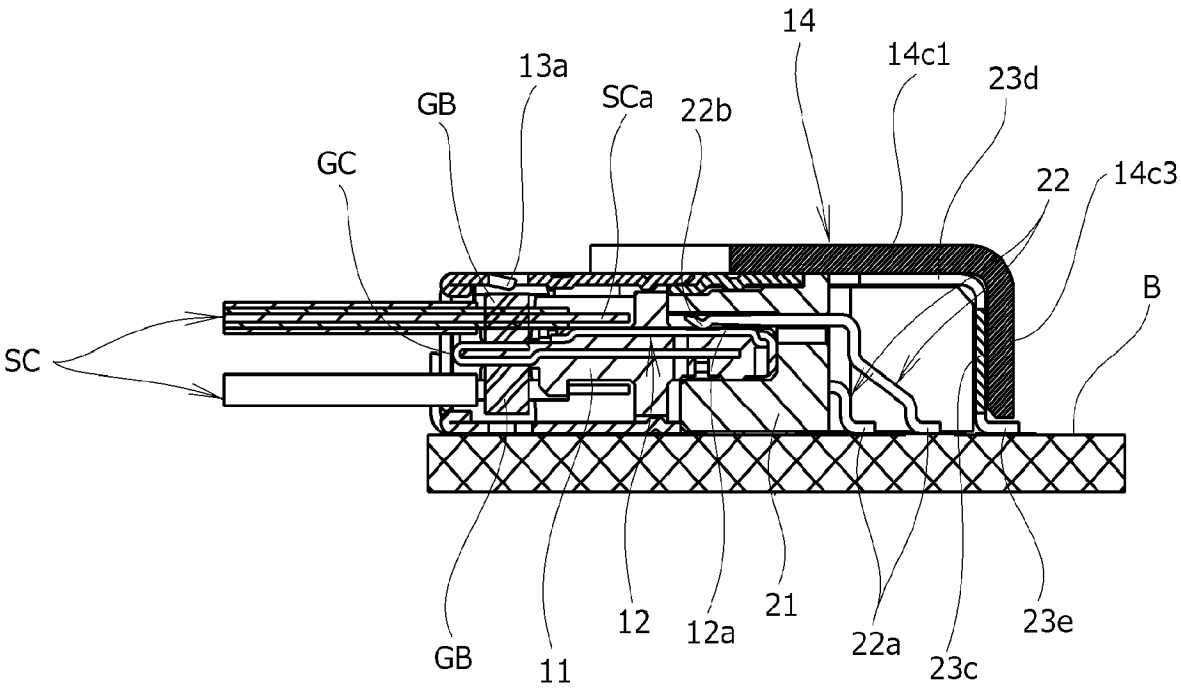
FIG. 10 is an explanatory transverse cross-sectional view taken along a line C-C shown in FIG. 7.
Figure 11:
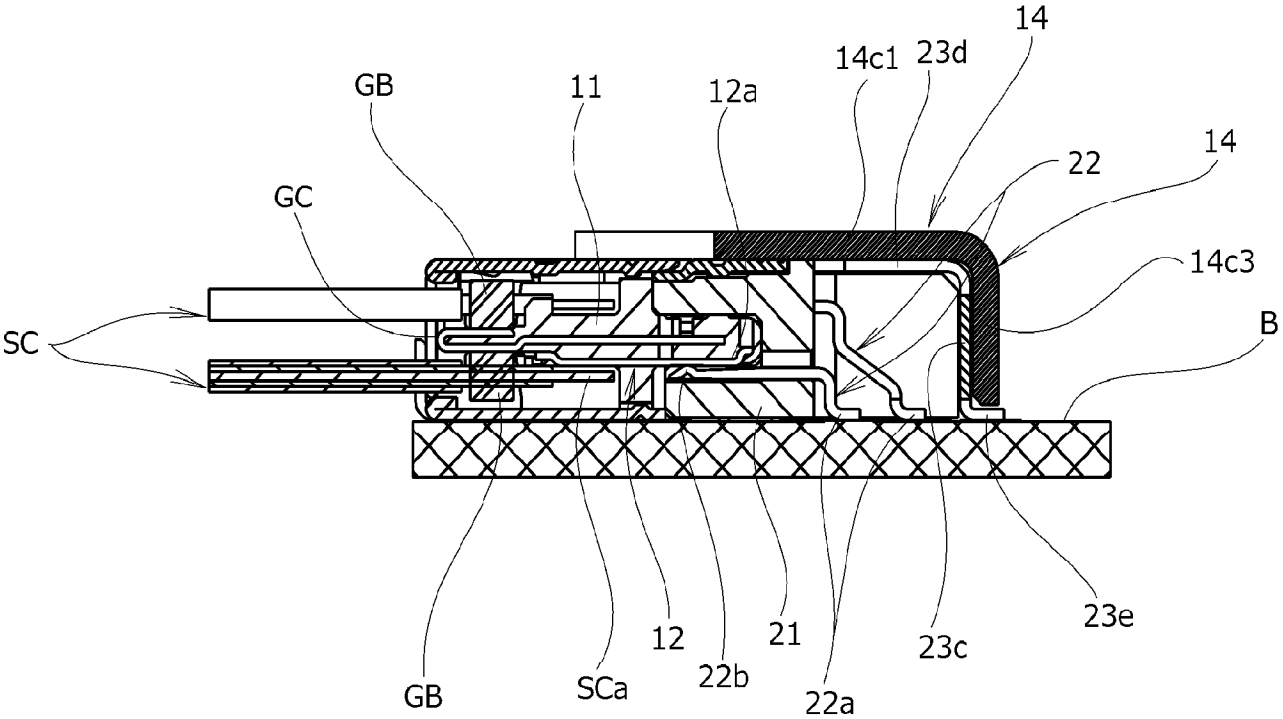
FIG. 11 is an explanatory transverse cross-sectional view taken along a line D-D shown in FIG. 7.
Figure 12:
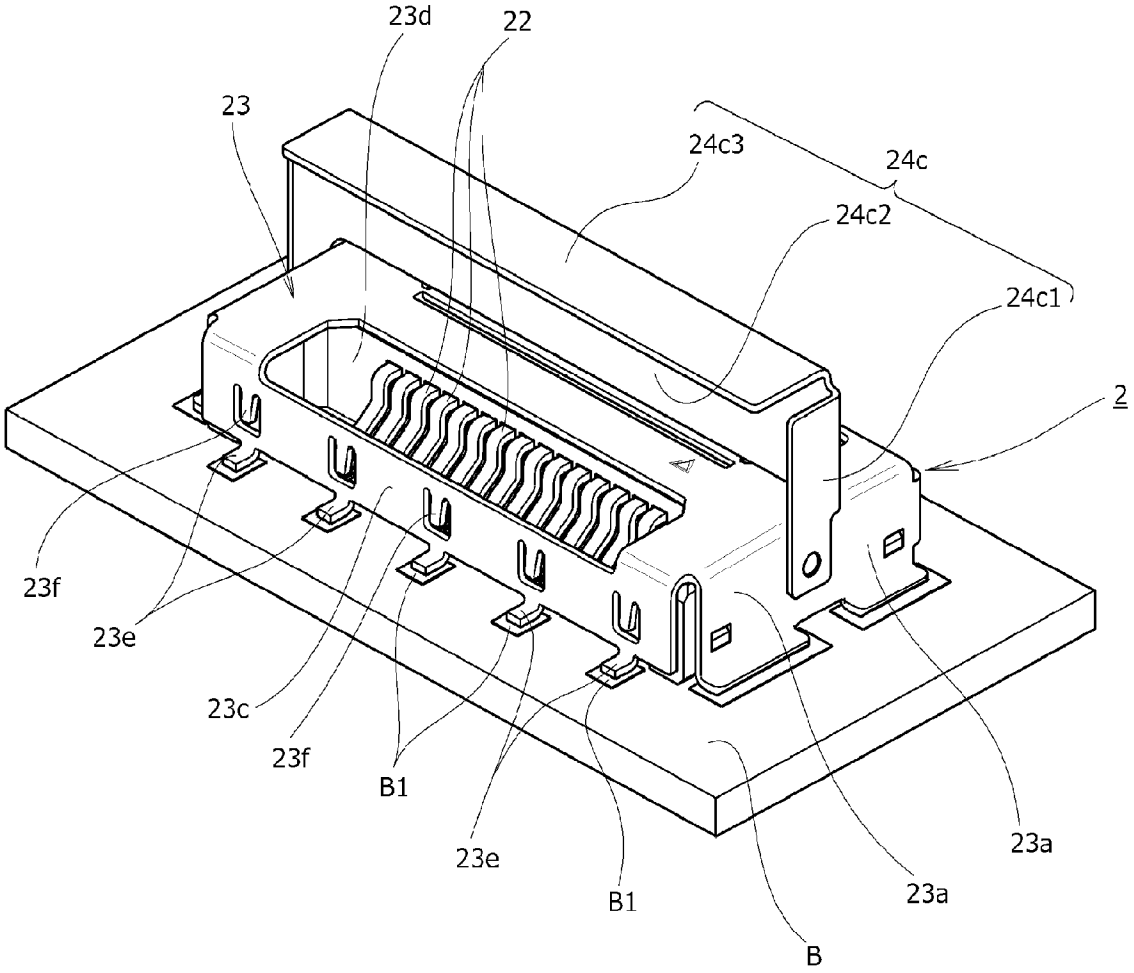
FIG. 12 is an appearance explanatory perspective view showing an initial state of a receptacle connector (second connector) according to a second embodiment of the present invention from an upper side in a connector rear side.

First, an electric connector device according to the first embodiment of the present invention shown in FIG. 1 to FIG. 11 is a horizontal-mating-type electric connector device provided with a plug connector 1, which is serving as a first connector (counterpart connector) to which terminal parts of coaxial cables SC constituting signal transmission media are coupled, and a receptacle connector 2, which is serving as a second connector mounted on a printed wiring substrate B. After the plug connector (first connector) 1 serving as the counterpart connector of mating is disposed so as to be opposed to the receptacle connector (second connector) 2 shown in FIG. 1 in an approximately horizontal direction, the plug connector 1 is horizontally moved in the direction approximately parallel to the surface of the printed wiring substrate B (extending direction of the printed wiring substrate B) so as to be close to the receptacle connector 2 side. As a result, a distal-end-side part of the plug connector 1 is inserted through an opening of the receptacle connector 2 into the interior thereof, and both of the connectors 1 and 2 are brought into a mated state as shown in FIG. 2.

In this manner, in the present embodiment, the direction of inserting the plug connector (first connector) 1 serving as the counterpart connector into the receptacle connector (second connector) 2 and the direction of removing in the opposite direction thereof are configured to be the direction that is approximately parallel to the direction in which the surface of the printed wiring substrate B is extended. Hereinafter, the direction in which the surface of the printed wiring substrate B is extended is referred to as "horizontal direction", and the direction orthogonal to the surface of the printed wiring substrate B is referred to as "top-bottom direction". In the plug connector 1 serving as the counterpart connector, the direction of inserting the plug connector 1 into the receptacle connector 2 is referred to as "forward direction", and the removing direction in the opposite direction thereof is referred to as "backward direction". Furthermore, in the receptacle connector 2, the direction of removing the plug connector 1 from the receptacle connector 2 is referred to as "forward direction", and the opposite direction thereof is referred to as "backward direction".

Both of the connectors, i.e., the plug connector (first connector) 1 and the receptacle connector (second connector) 2 constituting such an electrical connector device are respectively provided with insulating housings 11 and 21 serving as connector main body portions composed of insulating members formed in long and thin shapes. At the insulating housings (connector main body portions) 11 and 21, which are insulative, a plurality of electrically-conductive contact members (electrically-conductive terminals) 12 or 22 serving as contact members are arranged so as to form multipolar shapes at appropriate pitch intervals along the longitudinal direction of the insulating housing 11 or 21 (the direction perpendicular to the paper plane of FIG. 6).

Among the above described both electric connectors 1 and 2, to an end edge portion of a rear side of the plug connector (first connector) 1 (hereinafter, referred to as a rear end edge portion), the terminal parts of the plurality of coaxial cables SC, which are arranged so as to be juxtaposed in multipolar shapes along the connector longitudinal direction, are coupled across upper/lower two levels. Both of the coaxial cables SC and SC in the upper level and the lower level are mutually in a disposition relation in which the cables are mutually misaligned by a half pitch in the direction of the multipolar arrangement (connector longitudinal direction).

Particularly as shown in FIG. 8 to FIG. 11, at the terminal part of each of the coaxial cables SC like that, a cable central conductor (signal wire) SCa and a cable external conductor (shield wire) SCb are exposed so as to form a coaxial shape since a covering material is peeled off. The cable central conductor SCa, which is disposed so as to be along a central axis line of the coaxial cable SC, is connected to the electrically-conductive contact member (electrically-conductive terminal) 12 or 22 for signal transmission, and, as a result, a signal circuit is formed. The connection structure about the cable central conductor SCa will be explained later in detail.

Moreover, the cable external conductor SCb, which is disposed so as to concentrically surround the outer peripheral side of the above described cable central conductor SCa, is disposed so as to penetrate through the interior of a ground bar GB, which is constituting an electrically-conductive ground member in each of the multipolar arrangement levels of the upper/lower two levels. Each of the ground bars GB of the upper/lower two levels in the present embodiment is formed by a long-and-thin block-shaped member, which is extended in an elongated shape along the multipolar arrangement direction (connector longitudinal direction) of the above described coaxial cables SC, and each of the ground bars GB is collectively connected to the cable external conductors (shield wires) SCb of the coaxial cables SC by soldering, swaging, pressure welding, or the like. The ground bars GB of the upper/lower two levels provided in this manner are connected to a ground circuit, which is formed on the printed wiring substrate B via a later-described electrically-conductive shell, etc.

[Insulating Housings and Electrically-Conductive Contact Members]

Herein, each of the electric connectors, i.e., the plug connector (first connector) 1 and the receptacle connector (second connector) 2 described above is provided with the long-and-thin insulating housing (connector main body portion) 11 or 21, which is extended in a long and thin shape in the multipolar arrangement direction (connector longitudinal direction) of the electrically-conductive contact members (electrically-conductive terminals) 12 or 22 in the above described manner. The electrically-conductive contact members 12 or 22 attached to the insulating housing 11 or 21 are formed so as to have mutually different shapes to respectively correspond to the coaxial cables SC and SC in the upper/lower two levels, and the electrically-conductive contact members 12 or 22 of two types having mutually different shapes to correspond to the coaxial cables SC of the upper level side and the coaxial cables SC of the lower level side alternately disposed in the multipolar arrangement direction (connector longitudinal direction) are in an arrangement configuration so that they are alternately adjacent to each other in the multipolar arrangement direction.

On the other hand, the insulating housing 11 provided in the side of the plug connector 1 is formed by an insulating member of a resin or the like extending in the connector longitudinal direction (multipolar arrangement direction) in the above described manner, and the insulating housing 11 is configured to be integrally provided with a main-body supporting portion 11*a* serving as a connector main body portion disposed in the interior side of the plug connector 1 and a mating projection portion 11*b* provided so as to extend from the main-body supporting portion 11*a* toward a connector front side. In the interior of the insulating housing 11 from the main-body supporting portion 11*a* to the mating projection portion 11*b*, a ground contact GC, which contacts both of the ground bars GB and GB of the above described upper/lower two levels, is buried.

Furthermore, in the part from the main-body supporting portion 11*a* to the mating projection portion 11*b* of the above described insulating housing 11, the electrically-conductive contact members (first contact members) 12 are buried by insert molding or press fitting in a state in which the electrically-conductive contact members 12 are exposed from the upper/lower both surfaces of the insulating housing 11. More specifically, one of the electrically-conductive contact members 12, which are formed so as to form the two types of different shapes as described above, is disposed in a state in which the electrically-conductive contact member is extending approximately horizontally so as to be exposed from the upper-side surface of the insulating housing 11 to the upper side (see FIG. 8 and FIG. 10). The other one of the electrically-conductive contact members 12 is disposed in a state in which the electrically-conductive contact member 12 is extending approximately horizontally so as to be exposed from the lower-side surface of the insulating housing 11 to the lower side (see FIG. 9 and FIG. 11). These two types of electrically-conductive contact members 12 are alternately disposed in the multipolar arrangement direction (connector longitudinal direction).

The terminal parts of the cable central conductors (signal wires) SCa of the coaxial cables SC of the upper/lower two levels are respectively solder-connected to rear end parts of the electrically-conductive contact members (first contact members) 12 provided in the plug connector (first connector) 1 like this in a state in which the terminal parts are abutting the rear end parts from the upper side and the lower side. The solder joining between the cable central conductors SCa and the electrically-conductive contact members 12 can be collectively carried out, and the coaxial cables SC are coupled to the electrically-conductive contact members 12 of the plug connector 1 by such collective solder joining.

On the other hand, terminal electrode portions 12*a* constituting front-side parts of the above described electrically-conductive contact members (first contact members) 12 are disposed on upper/lower both surfaces of the mating projection portion 11*b*, which is provided in the front end side of the insulating housing (connector main body portion) 11 in the above described manner, so as to form multipolar-shape exposed electrodes. When the plug connector (first connector) 1 is mated with the receptacle connector (second connector) 2 in the above described manner, the terminal electrode portions 12*a* constituting front-side extended parts of the electrically-conductive contact members 12 abut the electrically-conductive contact members (second contact members) 22, which are provided in the receptacle connector 2, thereby constituting signal transmission circuits. The electrically-conductive contact members 12 and 22 can be also configured for ground connection.

Furthermore, the electrically-conductive contact members (second contact members) 22 attached to the insulating housing (connector main body portion) 21 in the side of the receptacle connector (second connector) 2 are arranged so that two types thereof are arranged to correspond to the two types of electrically-conductive contact members (first contact members) 12 of the side of the above described plug connector (first connector) 1 and form multipolar shapes in the connector longitudinal direction. One of the two types of electrically-conductive contact members 22 is in a disposition relation in which the electrically-conductive contact member 22 is extending to the upper side of the electrically-conductive contact member 12, which is disposed in the upper level side (see FIG. 8 and FIG. 10). The other electrically-conductive contact member 22 is disposed so as to extend to the lower side of the electrically-conductive contact member 12, which is disposed in the lower level side (see FIG. 9 and FIG. 11). The two types of electrically-conductive contact members 22 provided in the side of the receptacle connector 2 are configured to elastically contact the two types of electrically-conductive contact members 12 in the side of the plug connector 1 from the upper/lower both sides upon mutual mating of both of the electric connectors 1 and 2.

The rear end parts of the electrically-conductive contact members (second contact members) 22 (right-end-side parts of FIG. 8 to FIG. 12) attached to the receptacle connector (second connector) 2 respectively have substrate connecting leg portions 22*a*, which are formed so as to extend along the surface of the above described printed wiring substrate B. In actual usage (in a case of mounting), after the substrate connecting leg portions 22*a* are placed on signal electrically-conductive paths or ground-connecting electrically-conductive paths on the above described printed wiring substrate B, for example, collective solder joining is carried out.

The main body part of the electrically-conductive contact member (second contact member) 22 in the present embodiment has undergone bending so as to rise to the upper side from the substrate connecting leg portion 22*a* disposed in the above described connector rear end side, and the main body part is configured to extend in a cantilever shape from the upper end part of the rising part toward the front side (left side in FIG. 8 to FIG. 11). On the connector-front-side distal end parts of the electrically-conductive contact members 22, contact-point convex portions 22*b* bulging in a chevron shape toward the lower side and the upper side in the respective upper/lower multipolar arrangement levels are configured respectively. The apex portions in the lower side and the upper side of the contact-point convex portions 22*b* provided in the electrically-conductive contact members 22 are configured to elastically contact the terminal electrode portions 12*a* of the electrically-conductive contact members (first contact members) 12 in the side of the plug connector 1 from the upper side and the lower side when the plug connector (first connector) 1 is mated with the receptacle connector (second connector) 2 in the above described manner. By virtue of such an elastic contact relation, both of the above described contact point portions 12*a* and 22*b* are electrically connected to each other.

[About Electrically-Conductive Shells (Shield Shell Members)]

On the other hand, as shown in FIG. 2, the outer surfaces of the insulating housings (connector main body portions) 11 and 21 provided in the plug connector (first connector) 1 and the receptacle connector (second connector) 2 are covered respectively by first and second electrically-conductive shield shell members 13 and 23, which are formed by bending thin metal plate members into appropriate shapes. The first and second shield shell members 13 and 23 are attached as the members which provide an electromagnetic shielding characteristic (shielding characteristic) by covering the signal transmission circuits and the ground circuits formed in the electric connectors 1 and 2, but are also the members constituting part of the ground circuits.

Herein, the first shield shell member 13 provided in the side of the plug connector (first connector) 1 serving as the counterpart connector consists of mated bodies of paired shell pieces sandwiching the insulating housing (connector main body portion) 11 from the upper side and the lower side. First, the coaxial cables SC are set with respect to the insulating housing (connector main body portion) 11, both of the ground bars (ground members) GB and GB are solder-joined with respect to the coaxial cables SC, and, then, both of the shell piece members of an upper half part and a lower half part of the above described first shield shell member 13 are attached so as to cover the insulating housing (connector main body portion) 11 from the upper side and the lower side. On an upper-side surface and a lower-side surface of both of the shell pieces of the first shield shell member 13 as described above, a plurality of ground connection tongues 13*a* are formed by cutaway along the connector longitudinal direction, which is the multipolar arrangement direction. The ground connection tongues 13*a* are cut and raised so as to form cantilever plate spring shapes, which are projecting in oblique directions toward the space in the connector inner side, and are in elastic contact or solder-joined with the upper surface side of the above described ground bar GB.

[Electrically-Conductive Shell of Receptacle Connector (Shield Shell Member)]

On the other hand, the second shield shell member 23 of the receptacle connector (second connector) 2 is formed by a bent structure of a thin metal plate member attached to the insulating housing (connector main body portion) 21 so as to cover it from the upper side. Holddowns 23*a* are disposed at the connector-longitudinal-direction both end parts of the second shield shell member 23 so as to sandwich the insulating housing 21 from both outer sides in the same direction and to rise from the surface of the printed wiring substrate B.

These holddowns 23*a* are formed so that a pair thereof is formed in a connector-longitudinal-direction one-side part so as to form a lateral wall plate of the second shield shell member 23. Lower end edge portions of the holddowns 23*a* are solder-joined with ground-connecting electrically-conductive paths formed on the printed wiring substrate B so as to establish electrical connections of the ground circuits and firmly fix the entire receptacle connector 2.

Both of the holddowns 23*a* and 23*a*, which are disposed so as to form the lateral wall plates at the connector-longitudinal-direction both end parts in the above described manner, are integrally coupled to each other by an upper-side shell plate 23*b*, which is extending so as to form a planar-shape ceiling plate along the upper-side surface of the insulating housing 21. Furthermore, a fixed shield plate 23*c*, which is extending in the connector longitudinal direction, is provided at a part in the connector rear end side of the second shield shell member 23 so as to form a back side plate rising from the surface of the printed wiring substrate B.

Herein, in the upper-side shell plate 23*b*, which is disposed so as to form a ceiling shape of the above described second shield shell member 23, a shell opening 23*d* is formed at the part positioned above the rear end parts of the electrically-conductive contact members (second contact members) 22. The shell opening 23*d* is formed so as to cut away a rear-side region of the upper-side shell plate 23*b*. More specifically, the shell opening 23*d* is formed at a position above the substrate connecting leg portions 22*a*, which are the rear end parts of the electrically-conductive contact members 22, and vicinity parts thereof (upper rising parts) so as to extend along the connector longitudinal direction. The shell opening 23*d* has an opening length across the full length of the multipolar arrangement of the electrically-conductive contact members 22. Therefore, the rear end parts of the electrically-conductive contact members 22 including the substrate connecting leg portions 22*a* can be visually checked with respect to the surface of the printed wiring substrate B from a vertically upper side through the shell opening 23*d*.

As described above, the shell opening 23*d* is formed so as to cut away the rear-side region of the upper-side shell plate 23*b*, and a connector-rear-end-side end edge portion of the shell opening 23*d* is formed by the fixed shield plate 23*c*, which is disposed to form the back side plate. More specifically, in the rear-side region of the substrate connecting leg portions 22*a* of the electrically-conductive contact members (second contact members) 22, the fixed shield plate 23*c* is formed by a thin metal plate member, which is disposed so as to rise from the surface of the printed wiring substrate B, and an upper end edge portion of the fixed shield plate 23*c* extending in the connector longitudinal direction forms a rear end edge portion of the above described shell opening 23*d*.

The fixed shield plate 23*c*, which is provided so as to form the back side plate of the second shield shell member 23 in the above described manner, is disposed in a region close to the substrate connecting leg portions 22*a* of the electrically-conductive contact members (second contact members) 22 from the connector rear side. The fixed shield plate 23*c* is disposed so as to rise from the surface of the printed wiring substrate B to the upper side and is configured to be in a disposition relation in which the fixed shield plate 23*c* faces the substrate connecting leg portions 22*a* of the above described electrically-conductive contact members 22 from the connector rear side in a horizontal direction so that electromagnetic shielding (shielding) in the horizontal direction parallel to the surface of the printed wiring substrate B is carried out.

Moreover, a plurality of (five) ground connection portions 23*e*, 23*e*, and so on, which are in contact with grounding electrically-conductive paths B1 formed on the surface of the printed wiring substrate B, are formed at lower end edge parts of the fixed shield plate 23*c* so as to be bent and projecting approximately at right angle toward the connector rear side. The ground connection portions 23*e* are formed by cutting and raising the lower end edge parts of the fixed shield plate 23*c* and are disposed at approximately equal intervals in the connector longitudinal direction.

On the other hand, corresponding to the ground connection portions 23*e*, the plurality of (five) grounding electrically-conductive paths B1, B1, and so on are formed on the surface of the printed wiring substrate B so as to be juxtaposed approximately at equal intervals in the connector longitudinal direction. The grounding electrically-conductive paths B1 are formed in the regions close to the connector rear side with respect to the substrate connecting leg portions 22*a* of the electrically-conductive contact members (second contact members) 22 provided in the above described receptacle connector (second connector) 2, and the grounding electrically-conductive paths B1 are disposed at the positions corresponding to the ground connection portions 23*e* of the above described fixed shield plate 23*c*. The ground connection portions 23*e*, which are provided at the fixed shield plate 23*c* in this manner, are, for example, collectively solder-connected in a state in which they are placed on the grounding electrically-conductive paths B1 provided in the side of the printed wiring substrate B.

Then, in a state in which the fixed shield plate 23*c* is connected to the grounding electrically-conducive paths B1 via the ground connection portions 23*e* in the above described manner, a ground circuit is formed in the vicinity of the position at which electromagnetic shielding (shielding) is carried out by the fixed shield plate 23*c*.

Moreover, in the above described fixed shield plate 23*c*, a plurality of (five) plate-spring-shaped members 23*f*, 23*f*, and so on, which are contacted by a later-described movable shield cover 14*c* provided in the side of the plug connector (first connector) 1 serving as the counterpart connector, are formed. The plate-spring-shaped members 23*f* are formed by elastic members, which are formed by cutting and raising part of the fixed shield plate 23*c* in cantilever shapes, and are disposed so as to be juxtaposed in the connector longitudinal direction.

Furthermore, in the holddowns 23*a* constituting the lateral wall plates of the second shield shell member 23 in the above described manner, lock portions 23*g*, which are mated with a later-described mating retaining member 14 provided in the plug connector (first connector) 1 serving as the counterpart connector, are formed. The lock portions 23*g* are formed so as to bulge from the above described holddowns 23*a* toward the outer side in the connector longitudinal direction, and the mating retaining member 14 in the side of the plug connector 1 is configured to be engaged with the lock portions 23*g*.

[Mating Retaining Member]

More specifically, the mutually mated state of both of the electric connectors 1 and 2 in the case in which the plug connector (first connector) 1 serving as the counterpart connector is mated with the receptacle connector (second connector) 2 is configured to be retained by the retaining force of the mating retaining member 14 provided in the plug connector 1. When the plug connector 1 mated with the receptacle connector 2 is to be removed from the receptacle connector 2, both of the connectors 1 and 2 are brought into a mutually removable state by carrying out an operation of opening the mating retaining member 14.

More specifically, the mating retaining member 14 is turnably attached to the first shield shell member 13 of the above described plug connector (first connector) 1, and turning shaft portions 14*a* and 14*a* provided at connector-longitudinal-direction both end parts of the mating retaining member 14 are turnably inserted in bearing portions 13*d* and 13*d*, which are provided at connector-longitudinal-direction both end parts of the rear end part of the first shield shell member 13 in a freely mated state. The paired turning shaft portions 14*a* and 14*a* provided in the mating retaining member 14 are formed so as to form approximately rectangular shapes in a transverse cross section and is configured so as to apply biasing force of spring regulating members 13*e*, which are provided at the bearing portions 13*d*, to any of the flat surfaces constituting the outer peripheral surface of the turning shaft portions 14*a*. The turning shaft portions 14*a* are configured to be retained at an "unshielded position (unmated position)" and a "shielded position (mating working position)" described later by the biasing force of the spring regulating members 13*e*.

Moreover, paired coupling arm portions 14*b* and 14*b* are extending from connector-longitudinal-direction both-side outer end parts of the above described turning shaft portions 14*a* so as to be approximately along a turning radius direction. Turning-side distal end parts which are extending end parts of the coupling arm portions 14*b* and 14*b* are integrally coupled by the movable shield plate 14*c*, which is extending so as to form a plate shape along the connector longitudinal direction. The entire mating retaining member 14 is configured to be turned between the "unshielded position (unmated position)" shown in FIG. 2 and the "shielded position (mating working position)" shown in FIG. 3 to FIG. 7 when appropriate turning force is applied thereto while an assembly operator is holding part of the movable shield plate 14*c*.

The movable shield plate 14*c* provided in the mating retaining member 14 has undergone bending so as to form a hollow box shape covering the second shield shell member 23 of the above described receptacle connector (second connector) 2 from the upper side and is provided with an upper-surface-side shield cover 14*c*1 formed by a flat-plate-shaped member. Paired lock plates 14*c*2 and 14*c*2 are integrally continued to connector-longitudinal-direction both-side end edge portions of the upper-surface-side shield cover 14*c*1 so as to be bent approximately at right angle. Moreover, a back-side shield cover 14*c*3 is integrally continued to a connector-rear-end-side end edge portion of the upper-surface-side shield cover 14*c*1 so as to be bent approximately at right angle.

The upper-surface-side shield cover 14*c*1 among them forms a ceiling plate when the above described mating retaining member 14 is turned to the "mating working position". The upper-side shell plate 23*b* provided in the second shield shell member 23 in the side of the receptacle connector 2, the shell opening 23*d*, and the rear end parts of the electrically-conductive contact members (second contact members) 22 are configured to be covered by the upper-surface-side shield cover 14*c*1 of the movable shield plate 14*c* from the upper side. Since the upper-surface-side shield cover 14*c*1 of the movable shield plate 14*c* is configured to be in a disposition relation that it faces the rear end parts of the electrically-conductive contact members 22 including the substrate connecting leg portions 22*a* from the upper side in this manner, electromagnetic shielding (shielding) in the top-bottom direction perpendicular to the surface of the printed wiring substrate B is carried out.

Furthermore, both of the above described lock plates 14*c*2 and 14*c*2 are disposed so as to face each other in the connector longitudinal direction, and lock latch holes 14*c*4 are formed to penetrate through the respective lock plates 14*c*2. When the mating retaining member 14 is turned to the "mating working position" in the above described manner, the lock latch holes 14*c*4 formed to penetrate through the lock plates 14*c*2 are configured to be engaged with the lock portions 23*g*, which are provided in the side of the receptacle connector (second connector) 2.

More specifically, the holddowns 23*a* provided in the second shield shell member 23 of the receptacle connector (second connector) 2 in the above described manner are respectively provided with the lock portions 23*g*, which are mated with the lock latch holes 14*c*4 of the mating retaining member 14 turned to the above described "shielded position (mating working position)". The lock portions 23*g* are formed by plate-spring-shaped members bulging toward the outer side in the connector longitudinal direction. When the mating retaining member 14 is turned to the vicinity of the "shielded position (mating working position)" after both of the electric connectors 1 and 2 are mated with each other, the lock plates 14*c*2 provided in the mating retaining member 14 is moved so as to be moved over the outward bulging portions of the lock portions 23*g* in the side of the above described receptacle connector 2. Then, when the lock portions 23*g* are elastically displaced so as to be dropped into the inner side of the lock latch holes 14*c*4 of the mating retaining member 14, both of them become an engaged state. As a result, the entire mating retaining member 14 is elastically retained to the "shielded position (mating working position)".

When the mating retaining member 14 is turned from the "unshielded position (unmated position)" to the "shielded position (mating working position)" in the state in which the plug connector 1 is mated with the receptacle connector 2 in this manner, both of the electric connectors 1 and 2 are retained in a mutually mated state without being separated from each other by external force which is in a certain range.

The back-side shield cover 14*c*3 provided in the movable shield plate 14*c* in the above described manner is formed by a plate-shaped member extending from the rear end edge portion of the upper-surface-side shield cover 14*c*1 toward the lower side, and the back-side shield cover 14*c*3 is configured to be disposed so as to be overlapped with, from the connector rear side, the fixed shield plate 23*d* provided in the second shield shell member 23 in the side of the receptacle connector (second connector) 2. The back-side shield cover 14*c*3 elastically contacts the fixed shield plate 23*d* via the plate-spring-shaped members 23*f*, which are provided at the back-side shield cover 14*c*3.

In this manner, in the present embodiment, the part excluding the rear end side of the electrically-conductive contact members (second contact members) 22 attached to the receptacle connector (second connector) 2 is caused to be in a state in which they are covered from the beginning by the upper-side shell plate 23*b*, the holddowns 23*a* and 23*a*, and the fixed shield plate 23*c* of the second shield shell member 23. On the other hand, the plug connector (first connector) 1 serving as the counterpart connector is configured so that, when the mating retaining member 14 mated with the receptacle connector (second connector) 2 is turned from the "unshielded position (unmated position)" to the "shielded position (mating working position)", the movable shield plate 14*c* provided in the mating retaining member 14 covers the rear-end-side part of the electrically-conductive contact members (second contact members) 22. As a result, electromagnetic shielding (shielding) with respect to the electrically-conductive contact members 22 is carried out well.

Upon mutual mating of both of the electric connectors 1 and 2, the terminal electrode portions 12*a* of the electrically-conductive contact members (first contact members) 12 and the contact-point convex portions 22*b* of the electrically-conductive contact members (second contact members) 22 are caused to be in a connected state. The connected parts are configured to be covered by the second shield shell member 23 in the side of the above described receptacle connector (second connector) 2 and the movable shield plate 14*c* in the side of the plug connector (first connector) 1 from the outer side.

According to the embodiment according to the present invention provided with such a configuration, first, in the state in which the receptacle connector (second connector) 2 is mounted on the printed wiring substrate B, the state in which the fixed shield plate 23*c* provided in the second shield shell member 23 is covering the substrate connecting leg portions 22*a* of the electrically-conductive contact members (second contact members) 22 from the outer side in the connector rear side which is the direction opposed to the substrate connecting leg portions 22*a* is obtained. Then, from such a mounted state, both of the electric connectors 1 and 2 are mated with each other. Then, when the mating retaining member 14 undergoes a turning operation from the "unshielded position (unmated position)" to the "shielded position (mating working position)", the movable shield plate 14*c* provided in the mating retaining member 14 covers the shell opening 23*d* in the side of the receptacle connector (second connector) 2. As a result, the substrate connecting leg portions 22*a* of the electrically-conductive contact members 22 are covered by the movable shield plate 14*c* also from the perpendicularly upper side of the printed wiring substrate B, and electromagnetic shielding (shielding) with respect to the connected parts of the printed wiring substrate B and the electrically-conductive contact members 22 is carried out well.

Moreover, in the present embodiment, the fixed shield plate 23*c* is connected to the ground-connecting electrically-conductive paths B1 disposed in the vicinities of the substrate connecting leg portions 22*a* of the electrically-conductive contact members (second contact members) 22; as a result, ground connection is established at a vicinity position of the part at which electromagnetic shielding (shielding) is carried out, and good electromagnetic shielding characteristics are obtained.

Furthermore, in the present embodiment, before the movable shield plate 14*c* provided in the mating retaining member 14 is subjected to a turning operation toward the "shielded position (mating working position)" of covering the shell opening 23*d*, the connected parts of the printed wiring substrate B and the electrically-conductive contact members 22 are exposed to the outer side through the shell opening 23*d*. Therefore, the connection state at the connected parts can be checked well, for example, by a visual check from the upper side.

Furthermore, since the mating retaining member 14 is subjected to the turning operation after both of the electric connectors 1 and 2 are mated with each other, the mutual mating state of both of the electric connectors 1 and 2 is maintained well. At the same time, the ground connection for carrying out electromagnetic shielding (shielding) is reliably and firmly established by the gripping force of the mating retaining member 14, and the electromagnetic shielding (shielding) characteristics are further improved.

Furthermore, in the present embodiment, the movable shield plate 14*c* and the fixed shield plate 23*c* contact each other well via the plate-spring-shaped members 23*f*. Therefore, the electromagnetic shielding (shielding) characteristics are further improved.

Moreover, in the present embodiment, the receptacle connector (second connector) 2 is provided with the lock portions 23*g*, which retain the mating retaining member 14 at the "shielded position (mating working position)". Therefore, the mutual mating state of both of the electric connectors 1 and 2 is maintained well by the lock portions 23*g*.

Figure 13:
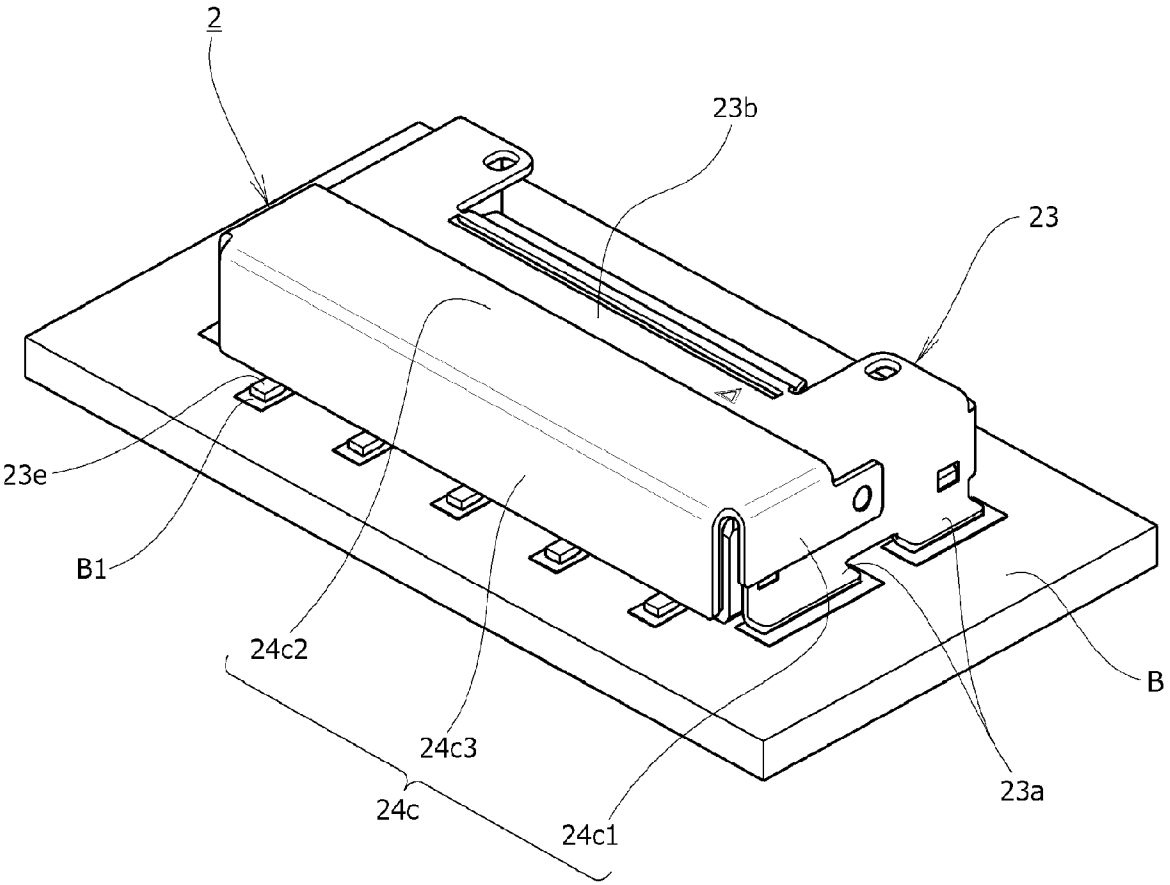
FIG. 13 is an appearance explanatory perspective view showing a state in which a movable shield plate is turned and closed from the state of FIG. 12.
Figure 14:
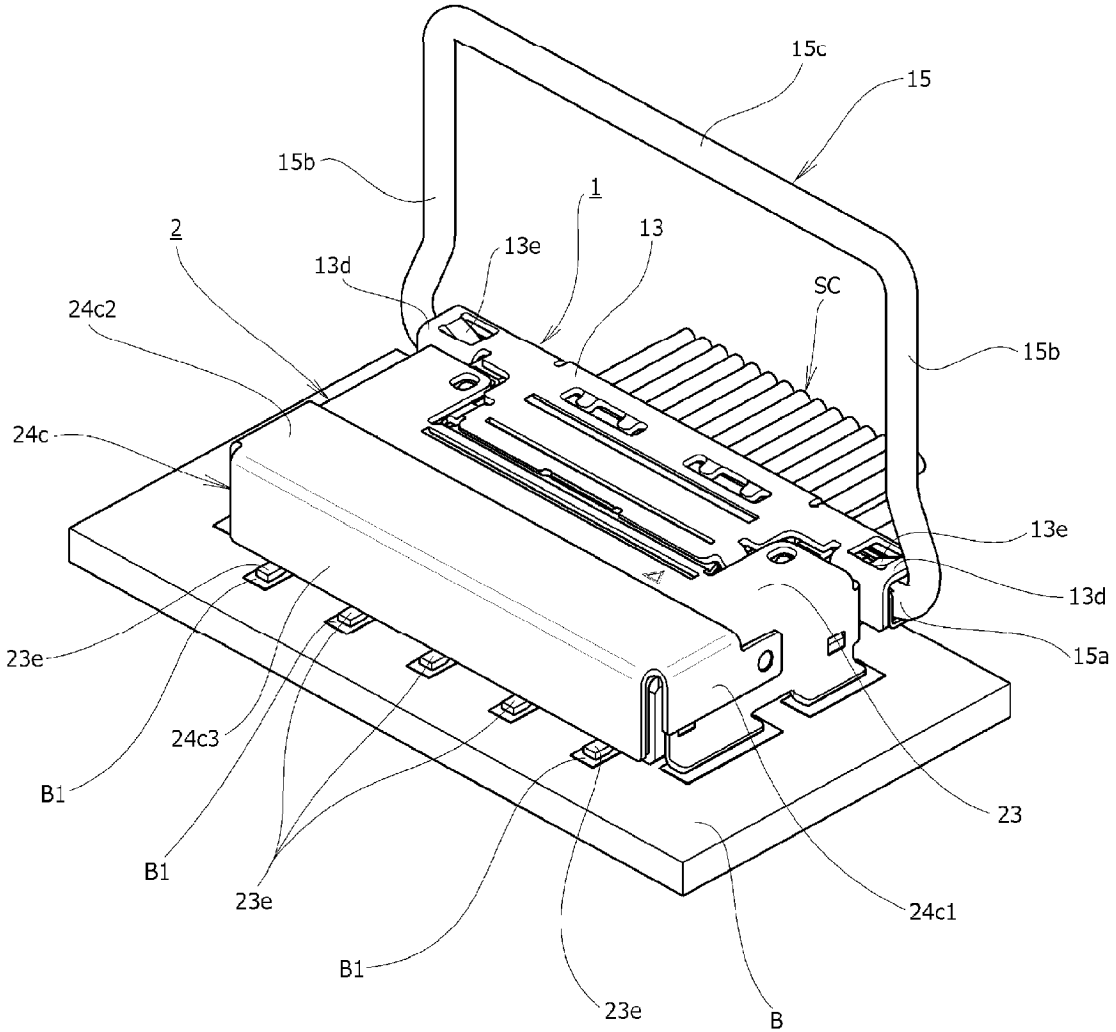
FIG. 14 is an appearance explanatory perspective view showing an electric connector device in a state immediately after a plug connector (first connector) serving as a counterpart connector is mated with the receptacle connector (second connector) in the state of FIG. 13.
Figure 15:
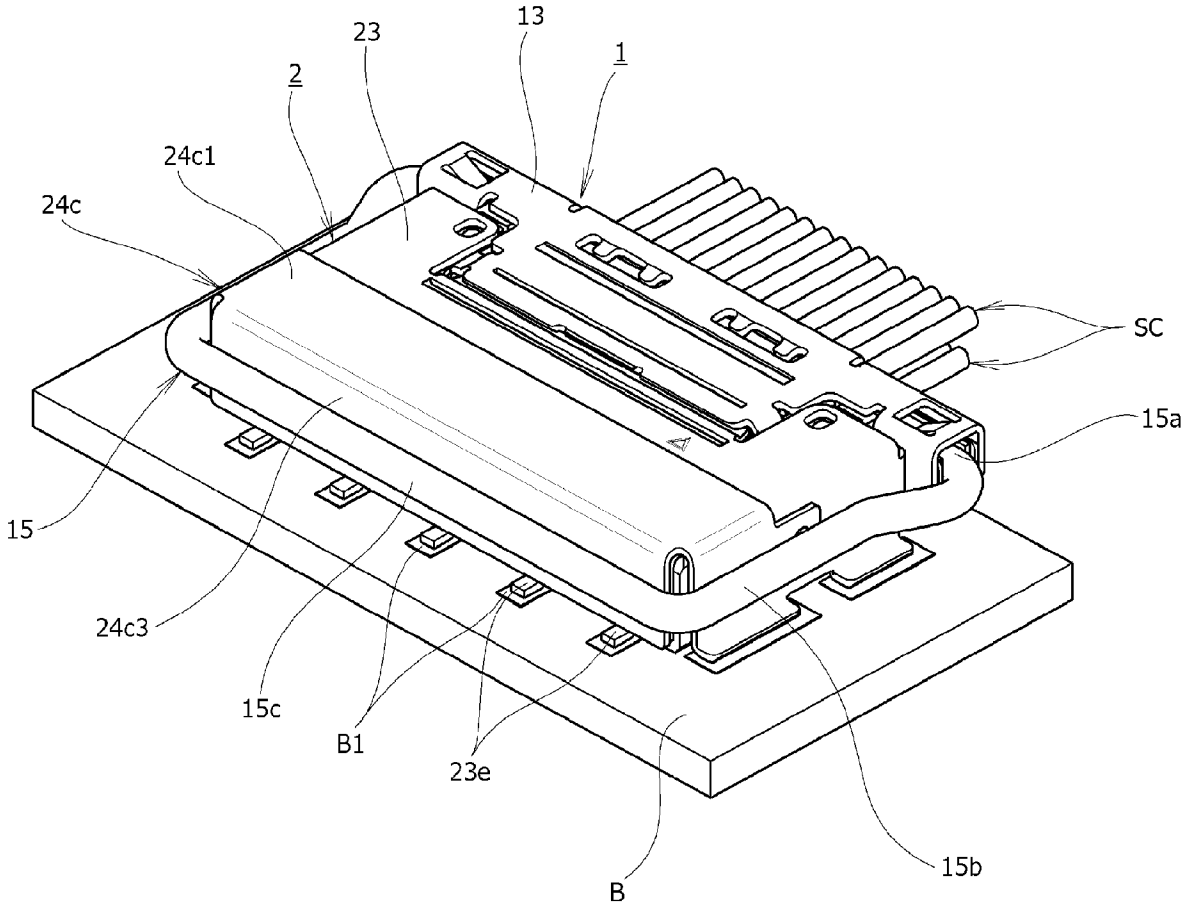
FIG. 15 is an appearance explanatory perspective view showing the electric connector device in a state after a mating retaining member at an "unmated position" in the state of FIG. 14 has undergone a turning operation to a "mating working position".

On the other hand, in the second embodiment according to FIG. 13 to FIG. 15, in which the same constituent members as those of the above described first embodiment are denoted with the same reference signs, the receptacle connector (second connector) 2 is provided with a movable shield plate 24*c*.

The movable shield plate 24*c* are turnably attached to holddowns 23*a* and 23*a*, which form both lateral wall plates of the second shield shell member 23, via turning arms 24*c*1 and 24*c*1, and an upper-surface-side shield cover 24*c*2 is provided so as to be bridged in the connector longitudinal direction across the turning-radius outer-side parts of the turning arms 24*c*1 and 24*c*1. Moreover, a back-side shield cover 24*c*3, which is bent at approximately right angle and extended, is integrally continued to a turning-radius outer-side end edge portion of the upper-surface-side shield cover 24*c*2.

The movable shield plate 24*c* like this is configured to be subjected to a turning operation between the "unshielded position" at which the shell opening 23*d* (see FIG. 1) formed in the rear-side region of the second shield shell member 23 in the above described manner is opened and the "shielded position" shown in FIG. 13. The shell opening 23*d* is closed by the upper-surface-side shield cover 24*c*2 of the movable shield plate 24*c*, which has turned to the "shielded position". As a result, the rear end parts including the substrate connecting leg portions 22*a* of the electrically-conductive contact members (second contact members) 22 are covered by the upper-surface-side shield cover 24*c*2 from the upper side.

In this manner, the upper-surface-side shield cover 24*c*2 of the movable shield plate 24*c* is in a disposition relation in which it faces, from the upper side, the rear end parts including the substrate connecting leg portions 22*a* of the electrically-conductive contact members 22. As a result, electromagnetic shielding (shielding) in the top-bottom direction perpendicular to the surface of the printed wiring substrate B is carried out.

Also in the second embodiment, similar to the above described first embodiment, the fixed shield plate 23*c* (illustration omitted), which forms a back side plate of the second shield shell member 23, is disposed in a region close to the substrate connecting legs 22*a* of the electrically-conductive contact members (second contact members) 22 from the connector rear side so as to rise from the surface of the printed wiring substrate B to the upper side. Since the fixed shield plate 23*c* is in the disposition relation in which it faces the substrate connecting leg portions 22*a* of the electrically-conductive contact members 22 from the connector rear side, electromagnetic shielding (shielding) in the horizontal direction (the extending direction of the printed wiring substrate B) which is parallel to the surface of the printed wiring substrate B is carried out.

[Mating Retaining Member]

On the other hand, the mated state in which the plug connector (first connector) 1 serving as the counterpart connector is mated with the receptacle connector (second connector) 2 as shown in FIG. 14 is configured to be maintained by a mating retaining member 15 provided in the plug connector (counterpart connector) 1 as shown in FIG. 15. When the plug connector 1 mated with the receptacle connector 2 is to be removed from the receptacle connector 2, an operation of opening the mating retaining member 15 is carried out, thereby causing both of the electric connectors 1 and 2 to be a mutually removable state.

More specifically, the above described mating retaining member 15 is configured to be turnably attached to the first shield shell member 13, and turning shaft portions 15*a* and 15*a* provided at connector-longitudinal-direction both end parts of the mating retaining member 15 are turnably inserted in the bearing portions 13*d* and 13*d*, which are provided at connector-longitudinal-direction both end parts of the rear end part of the first shield shell member 13. Similar to the above described embodiment, the biasing force of the spring regulating members 13*e* provided at the bearing portions 13*d* is applied to the paired turning shaft portions 15*a* and 15*a* provided in the mating retaining member 15 so that the turning shaft portions 15*a* are configured to be retained at the "unmated position" and the "mating working position".

Moreover, coupling arm portions 15*b* are extending from connector-longitudinal-direction outer end parts of the above described turning shaft portions 15*a* so as to be approximately along the turning radius direction, and turning-side distal-end parts which are extending end parts of the coupling arm portions 15*b* are integrally coupled to each other by a turning operating portion 15*c*, which is extending approximately linearly along the connector longitudinal direction. The entire mating turning arm 15 is configured to be turned between the illustration-omitted "unmated position" and the illustrated "mating working position" when an operator holds part of the turning operating portion 15*c* and applies appropriate turning force thereto.

In the state in which the plug connector (first connector) 1 is mated with the receptacle connector (second connector) 2 in this manner, when the mating retaining member 15 is turned from the "unmated position" to the "mating working position", the turning operating portion 15*c* of the mating retaining member 15 abuts, from the rear side, the back-side shield cover 24*c*3 of the movable shield plate 24*c* at the "shielded position". As a result, the movable shield plate 24*c* is retained at the "shielded position", and both of the electric connectors 1 and 2 are retained in the mated state without being separated from each other.

The turning operating portion 15*c* of the mating retaining member 15 in a case in which it is turned to the "mating working position" is disposed so as to be close to the ground connection portions 23*e* of the above described fixed shield plate 23*c* from the upper side.

Similar to the above described first embodiment, also in the second embodiment like this, electromagnetic shielding (shielding) with respect to the connected parts of the printed wiring substrate B and the electrically-conductive contact members 22 is carried out well; and, since the connected parts of the printed wiring substrate B and the electrically-conductive contact members 22 are exposed to outside through the shell opening 23*d* until the movable shield plate 24*c* is subjected to the turning operation toward the "shielded position" at which the shell opening 23*d* is covered thereby, and the connection state at the connected parts is checked well, for example, by visual check from the upper side.

Hereinabove, the invention accomplished by the present inventors have been explained in detail based on the embodiments. However, the present invention is not limited to the above described embodiments, and it goes without saying that various modifications can be made within the range not deviating from the gist thereof.

For example, the present invention is not limited to the connectors for coaxial cables such as those of the above described embodiments, but can be similarly applied also to connectors for insulation cables, electric connectors of a type in which a plurality of coaxial cables and insulation cables are mixed, electric connectors coupled to flexible wiring substrates, etc., substrate-to-substrate connectors which mutually connect printed substrates, etc.

As described above, the present embodiments can be widely applied to various electric connectors which are used in various electric devices.

What is claimed is:

1. An electric connector having a connector main body portion configured to mate with a counterpart connector in a state in which the electric connector is mounted on a wiring substrate, the electric connector comprising:

a shield shell member attached to the connector main body portion to cover at least part of the connector main body portion, and a contact member attached to the connector main body portion and having a substrate connecting leg portion to connect to an electrically-conductive path on the wiring substrate; wherein a ground-connecting electrically-conductive path is formed on a surface of the wiring substrate and in a vicinity of a part to which the substrate connecting leg portion of the contact member is connected;

the shield shell member is provided with a fixed shield plate that rises from the surface of the wiring substrate and has a surface that faces the substrate connecting leg portion of the contact member in a state in which the fixed shield plate is solder-connected to the ground-connecting electrically-conductive path, and a shell opening that exposes the substrate connecting leg portion of the contact member toward a direction perpendicular to the surface of the wiring substrate;

a movable shield plate configured to cover the shell opening is provided that is reciprocable between an unshielded position at which the shell opening is in an open state and a shielded position at which the shell opening is in a closed state; and the movable shield plate is configured to contact the fixed shield plate when the movable shield plate is moved to the shielded position.

2. The electric connector according to claim 1, wherein the movable shield plate is turnably provided at the counterpart connector.

3. The electric connector according to claim 1, wherein the movable shield plate is turnably provided at the shield shell member.

4. The electric connector according to claim 1, wherein a mating retaining member is turnably attached to the counterpart connector;

in a case in which both of the electric and counterpart connectors are mutually mated, the mating retaining member is configured to turn from an unmated position to a mating working position to maintain a mutually mated state of both of the electric and counterpart connectors; and the mating retaining member is integrally provided with the movable shield plate.

5. The electric connector according to claim 4, wherein further comprising:

a lock portion that retains the mating retaining member at the mating working position.

6. The electric connector according to claim 1, wherein the fixed shield plate is provided with a plurality of plate-spring-shaped members that elastically contact the fixed movable shield plate.

7. The electric connector according to claim 1, wherein the surface of the fixed shield plate directly faces the substrate connecting leg portion of the contact member.

8. The electric connector according to claim 1, wherein the surface of the fixed shield plate faces the substrate connecting leg portion in a direction parallel to the surface of the wiring substrate.

9. An electric connector device, comprising:

a first connector to which a terminal part of a signal transmission medium is coupled, and a second connector configured to mate with the first connector in a state in which the second connector is mounted on a surface of a wiring substrate, the second connector including a connector main body portion to which a shield shell member that covers at least part of the connector main body portion is attached, and including a contact member attached to the connector main body portion and having a substrate connecting leg portion connected to an electrically-conducive path on the wiring substrate; wherein a ground-connecting electrically-conductive path is formed on the surface of the wiring substrate and in a vicinity of a part to which the substrate connecting leg portion of the contact member is connected;

the shield shell member is provided with a fixed shield plate that rises from the surface of the wiring substrate and has a surface that faces the substrate connecting leg portion of the contact member in a state in which the fixed shield plate is solder-connected to the ground-connecting electrically-conductive path, and a shell opening that exposes the substrate connecting leg portion of the contact member toward a direction perpendicular to the surface of the wiring substrate;

the first connector or the second connector is provided with a movable shield plate configured to cover the shell opening, the movable shield plate being reciprocable between an unshielded position at which the shell opening is in an open state and a shielded position at which the shell opening is in a closed state; and the movable shield plate is configured to contact the fixed shield plate when the movable shield plate is moved to the shielded position.

10. The electric connector device according to claim 9, wherein the movable shield plate is turnably provided at the first connector.

11. The electric connector device according to claim 9, wherein the movable shield plate is turnably provided at the second connector.

12. The electric connector device according to claim 9, wherein a mating retaining member is turnably attached to the first connector;

in a case in which both of the first and second connectors are mutually mated, the mating retaining member is configured to turn from an unmated position to a mating working position to maintain a mutually mated state of both of the first and second connectors; and the mating retaining member is integrally provided with the movable shield plate.

13. The electric connector device according to claim 9, wherein the fixed shield plate is provided with a plurality of plate-spring-shaped members that elastically contact the movable shield plate.

14. The electric connector device according to claim 12, further comprising:

a lock portion that retains the mating retaining member at the mating working position.

15. The electric connector device according to claim 9, wherein the surface of the fixed shield plate directly faces the substrate connecting leg portion of the contact member.

16. The electric connector device according to claim 9, wherein the surface of the fixed shield plate faces the substrate connecting leg portion in a direction parallel to the surface of the wiring substrate.

* * * * *